US009988751B2

(12) United States Patent
Fugal et al.

(10) Patent No.: US 9,988,751 B2
(45) Date of Patent: Jun. 5, 2018

(54) LAUNDRY TREATING APPLIANCE AND METHODS OF REDUCING TUB CONTACT THEREIN

(71) Applicant: WHIRLPOOL CORPORATION, Benton Harbor, MI (US)

(72) Inventors: Nicholas C. Fugal, Benton Harbor, MI (US); Brian P. Janke, Saint Joseph, MI (US); Stephen L. Keres, Stevensville, MI (US); Bradley D. Morrow, Stevensville, MI (US); Erol D. Sumer, East Lansing, MI (US); Ran Zhao, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 85 days.

(21) Appl. No.: 14/812,338

(22) Filed: Jul. 29, 2015

(65) Prior Publication Data

US 2017/0030004 A1 Feb. 2, 2017

(51) Int. Cl.
*D06F 33/02* (2006.01)
*D06F 37/30* (2006.01)

(52) U.S. Cl.
CPC ..... *D06F 37/304* (2013.01); *D06F 33/02* (2013.01); *D06F 2202/12* (2013.01); *D06F 2204/065* (2013.01)

(58) Field of Classification Search
CPC ..... D06F 37/304
See application file for complete search history.

(56) References Cited

U.S. PATENT DOCUMENTS

| | | | |
|---|---|---|---|
| 4,782,544 | A | 11/1988 | Nystuen et al. |
| 5,293,760 | A | 3/1994 | Tani et al. |
| 5,692,313 | A | 12/1997 | Ikeda et al. |
| 5,765,402 | A | 6/1998 | Ikeda et al. |
| 5,893,280 | A | 4/1999 | Honda et al. |
| 5,905,648 | A | 5/1999 | Badami |
| 6,393,918 | B2 | 5/2002 | French et al. |
| 6,505,369 | B1 | 1/2003 | Weinmann |
| 6,633,149 | B1 | 10/2003 | Foureys |
| 7,162,759 | B2 | 1/2007 | Weinmann |
| 7,296,445 | B2 | 11/2007 | Zhang et al. |
| 7,380,303 | B2 | 6/2008 | Bellinetto et al. |
| 7,591,038 | B2 | 9/2009 | Murray et al. |
| 7,905,122 | B2 | 3/2011 | Murray et al. |
| 7,958,585 | B2 | 6/2011 | Zhang et al. |
| 8,122,549 | B2 | 2/2012 | Park et al. |
| 8,186,227 | B2 | 5/2012 | Ashrafzadeh |

(Continued)

FOREIGN PATENT DOCUMENTS

| | | | |
|---|---|---|---|
| CA | 2411700 | A1 | 6/2003 |
| DE | 19802650 | A1 | 7/1999 |

(Continued)

*Primary Examiner* — Jason Ko

(57) ABSTRACT

Methods of reducing a likelihood of contact between a rotating laundry-container, such as a basket or drum, located within a tub of a laundry treating appliance where the method includes accelerating a rotational speed of the rotating laundry-container during an extraction cycle speed ramp, monitoring the friction associated with the rotating laundry-container during the speed ramp and comparing to a threshold and altering the accelerating of the rotational speed of the rotating laundry-container when the comparing indicates the threshold is satisfied.

18 Claims, 7 Drawing Sheets

(56) References Cited

U.S. PATENT DOCUMENTS

| | | | |
|---|---|---|---|
| 8,250,690 | B2 | 8/2012 | Jurmann et al. |
| 8,312,581 | B2 | 11/2012 | Pelczer |
| 8,489,358 | B2 | 7/2013 | Petronilho et al. |
| 8,819,880 | B2 | 9/2014 | Ashrafzadeh et al. |
| 8,875,332 | B2 | 11/2014 | Janke et al. |
| 8,910,335 | B2 | 12/2014 | Kim et al. |
| 8,943,629 | B2 | 2/2015 | Paul et al. |
| 8,984,693 | B2 | 3/2015 | Ashrafzadeh et al. |
| 9,010,159 | B2 | 4/2015 | Sharp |
| 9,080,277 | B2 | 7/2015 | Erickson et al. |
| 9,091,011 | B2 | 7/2015 | Janke et al. |
| 9,091,012 | B2 | 7/2015 | Ashrafzadeh et al. |
| 9,096,964 | B2 | 8/2015 | Albayrak et al. |
| 2003/0115682 | A1 | 6/2003 | Gardner |
| 2006/0242768 | A1 | 11/2006 | Zhang et al. |
| 2008/0041115 | A1 | 2/2008 | Kanazawa et al. |
| 2008/0041116 | A1 | 2/2008 | Kanazawa et al. |
| 2008/0178398 | A1 | 7/2008 | Darby et al. |
| 2009/0106913 | A1 | 4/2009 | Suel, II et al. |
| 2009/0308110 | A1 | 12/2009 | Koo et al. |
| 2011/0067185 | A1 | 3/2011 | Koo et al. |
| 2012/0144599 | A1 | 6/2012 | Polli et al. |
| 2012/0151686 | A1 | 6/2012 | Jang et al. |
| 2012/0151693 | A1 | 6/2012 | Jang et al. |
| 2012/0151694 | A1 | 6/2012 | Jang et al. |
| 2012/0246835 | A1 | 10/2012 | Ashrafzadeh et al. |
| 2013/0000054 | A1 | 1/2013 | Zasowski |
| 2013/0031939 | A1 | 2/2013 | Hasanreisoglu et al. |
| 2013/0047344 | A1 | 2/2013 | Janke et al. |
| 2013/0152311 | A1 | 6/2013 | Janke et al. |
| 2013/0152312 | A1 | 6/2013 | Janke et al. |
| 2013/0160220 | A1 | 6/2013 | Ashrafzadeh et al. |
| 2013/0160221 | A1 | 6/2013 | Ashrafzadeh et al. |
| 2013/0160498 | A1 | 6/2013 | Erickson et al. |
| 2014/0013518 | A1 | 1/2014 | Janke et al. |
| 2014/0215725 | A1 | 8/2014 | Paglia et al. |
| 2014/0318246 | A1 | 10/2014 | Miyaji |
| 2014/0379142 | A1 | 12/2014 | Borlin et al. |
| 2015/0047396 | A1 | 2/2015 | Beckert Polli et al. |
| 2015/0101668 | A1 | 4/2015 | Janke et al. |

FOREIGN PATENT DOCUMENTS

| | | | |
|---|---|---|---|
| DE | 102012223611 | A1 | 6/2014 |
| DE | 102014109650 | A1 | 2/2015 |
| EP | 0433157 | A1 | 6/1991 |
| EP | 0494667 | A1 | 7/1992 |
| EP | 0704568 | B1 | 12/1998 |
| EP | 0921226 | A2 | 6/1999 |
| EP | 1350881 | A1 | 10/2003 |
| EP | 1734167 | B1 | 9/2007 |
| EP | 2607536 | A1 | 6/2013 |
| EP | 2765230 | A1 | 8/2014 |
| JP | 05277289 | A | 10/1993 |
| WO | 2004097099 | A1 | 11/2004 |

LAUNDRY TREATING APPLIANCE AND METHODS OF REDUCING TUB CONTACT THEREIN

BACKGROUND

Laundry treating appliances, such as washing machines, refreshers, and non-aqueous systems, can have a configuration based on a rotating container that defines a treating chamber in which laundry items are placed for treating. In a vertical axis washing machine, the container is in the form of a perforated basket located within a tub; both the basket and tub typically have an upper opening at their respective upper ends. In a horizontal axis washing machine, the container is in the form of a perforated drum located within a tub; both the drum and tub typically have an opening at their respective front facing ends. The laundry treating appliance can have a controller that implements the cycles of operation having one or more operating parameters. The controller can control a motor to rotate the container according to one of the cycles of operation. When laundry is loaded within the container, the rotation of the container via the motor can cause contact between the container and the tub.

BRIEF SUMMARY

In one aspect, an embodiment of the invention relates to a method of reducing the likelihood of contact between a rotating laundry-container located within a tub of a laundry treating appliance, the method includes accelerating the rotational speed of the laundry-container during an extraction cycle speed ramp, monitoring the friction associated with the rotating laundry-container during the speed ramp, comparing the monitored friction to a threshold friction value, which is correlated to a gap size between the rotating laundry-container and the tub, and altering the accelerating of the rotational speed of the laundry-container when the comparing indicates the threshold is satisfied.

In another aspect, an embodiment of the invention relates to laundry treating appliance, including a tub, a rotating laundry-container located within the tub and at least partially defining a treating chamber in which a laundry load is received for treatment, a motor operably coupled with the rotating laundry-container and configured to rotatably drive the rotating laundry-container in response to a motor control signal, and a controller configured to output the motor control signal to rotate the rotating laundry-container and accelerate a rotational speed of the rotating laundry-container during an extraction cycle speed ramp, monitor a friction associated with the rotating laundry-container during the speed ramp, compare the monitored friction to a threshold friction value, which is correlated to a gap size between the rotating laundry-container and the tub and alter the accelerating of the rotational speed of the rotating laundry-container when the comparing indicates the threshold is satisfied.

DETAILED DESCRIPTION

Embodiments of the invention relate to reducing a likelihood of a container-tub contact during operation of a laundry treating appliance. Existing solutions in vertical axis machines include extrapolating the high speed behavior of the machine based on an off-balance estimation that is performed at low speeds. This does not detect high speed off-balance or the issues it creates at high speed and thus has several drawbacks. First, due to the uncertainty of water extraction rates during the high speed spin, the extrapolation at low speeds cannot accurately capture the true extraction rate at high speeds, and thus leads to an inaccurate high speed off-balance estimate. Second, although there is correlation between an off-balance mass and the likelihood of a container-tub contact, in some cases, a container-tub contact could occur with a perfectly distributed load that has no off-balance. Therefore, decision logic to prevent container-tub contact that is based on off-balance load estimation generally contains some level of risk.

Existing solutions in a horizontal axis washing machine include adding small periods of dwell to the ramp and monitoring the changes in the torque value between consecutive dwells. However, such existing methods may require the use of these additional dwells to the spin cycle. Furthermore, since the torque value is affected by changes in the coulomb friction, and, to some extent, the load size, existing methods are inferior in terms of accuracy, precision, and robustness. Furthermore, existing solutions are prone to sudden failures that could occur between the consecutive dwells.

Figure 1:
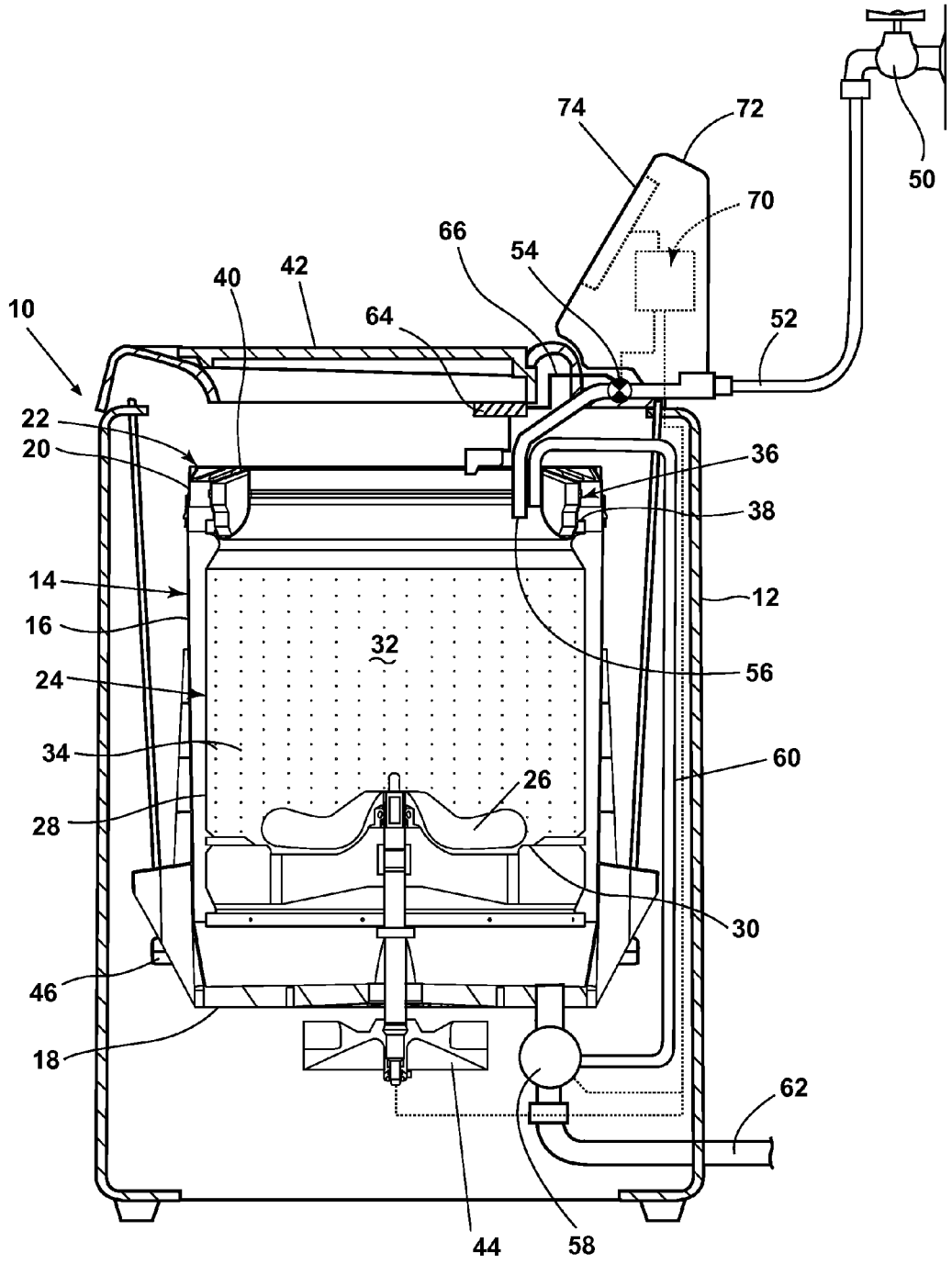
FIG. 1 is a schematic sectional view of a laundry treating appliance in the form of a vertical washing machine.

FIG. 1 is a schematic view of a laundry treating appliance according to an exemplary embodiment, which can be operated according to an embodiment of the invention to reduce the likelihood of contact between a rotating laundry-container and a tub. The laundry treating appliance can be any appliance that performs a cycle of operation to clean or otherwise treat items placed therein, non-limiting examples of which include a horizontal or vertical axis clothes washing machine, a combination washing machine and dryer, a tumbling refreshing/revitalizing machine, an extractor, and a non-aqueous washing apparatus.

The laundry treating appliance of FIG. 1 is illustrated as a vertical axis washing machine 10, which can include a structural support system comprising a cabinet 12 that defines a housing within which a laundry holding system resides. The cabinet 12 can be a housing having a chassis and/or a frame, defining an interior receiving components typically found in a conventional washing machine, such as motors, pumps, fluid lines, controls, sensors, transducers, and the like. Such components will not be described further herein except as necessary for a complete understanding of the invention.

The laundry holding system of the illustrated exemplary washing machine 10 can include a watertight tub 14 installed in the cabinet 12. The tub 14 can have a generally cylindrical side or peripheral wall 16 closed at its bottom end by a base that can at least partially define a sump 18. An upper edge 20 of the peripheral wall 16 can define an opening to an interior of the tub 14 for holding liquid, and a tub ring 22 can be mounted to the tub 14 at or near the upper edge 20.

A rotating laundry-container is illustrated in the form of a perforated basket 24, which can be mounted in the tub 14 for rotation about an axis of rotation, such as, for example, a central, vertical axis extending through the center of a laundry mover 26 in the form of an impeller, as an example, located within the basket 24. Other exemplary types of laundry movers include, but are not limited to, an agitator, a wobble plate, and a hybrid impeller/agitator. The basket 24 can have a generally cylindrical side or peripheral wall 28 closed at its bottom end by a base 30 to form an interior at least partially defining a laundry treating chamber 32 receiving a load of laundry items for treatment. The peripheral wall 28 can include a plurality of perforations or apertures 34 such that liquid supplied to the basket 24 can flow through the perforations 34 to the tub 14. A balance ring 36 can be coupled with an upper edge 38 of the basket peripheral wall 28 to counterbalance a load imbalance that can occur within the treating chamber 32 during a cycle of operation. While the washing machine 10 can employ any type of balance ring 36, an exemplary balance ring is disclosed in U.S. Patent Application Publication No. US20110247373, filed Jan. 31, 2011, now U.S. Pat. No. 9,010,159, issued Apr. 21, 2015, whose disclosure is incorporated by reference in its entirety. The illustrated balance ring 36 can include a chamfered or inclined top wall 40 on an upper portion of the balance ring 36. The chamfer or incline of the top wall 40 can be approximately 35 degrees from a horizontal plane. As illustrated, the entire top wall 40 is inclined, but it is contemplated that alternatively only a portion of the top wall 40 is inclined relative to the horizontal, as shown and described in the aforementioned and incorporated '373 publication. The top of the cabinet 12 can include a selectively openable lid 42 to provide access into the laundry treating chamber 32 through an open top of the basket 24.

A drive system including a drive motor 44, which can include a gear case, can be utilized to rotate the basket 24 and the laundry mover 26. The motor 44 can rotate the basket 24 at various speeds, including at a spin speed wherein a centrifugal force at the inner surface of the basket peripheral wall 28 is 1 g or greater; spin speeds are commonly known for use in extracting liquid from the laundry items in the basket 24, such as after a wash or rinse step in a treating cycle of operation. The motor 44 can also oscillate or rotate the laundry mover 26 about its axis of rotation during a cycle of operation in order to provide movement to the load contained within the laundry treating chamber 32. The illustrated drive system for the basket 24 and the laundry mover 26 is provided for exemplary purposes only and is not limited to that shown in the drawings and described above.

A suspension system 46 can dynamically hold the tub 14 within the cabinet 12. The suspension system 46 can dissipate a determined degree of vibratory energy generated by the rotation of the basket 24 and/or the laundry mover 26 during a treating cycle of operation. Together, the tub 14, the basket 24, and any contents of the basket 24, such as liquid and laundry items, define a suspended mass for the suspension system 46. The suspension system 46 can be any type of suspension system.

The washing machine 10 can be fluidly connected to a liquid supply 50 through a liquid supply system including a liquid supply conduit 52 having a valve assembly 54 that can be operated to selectively deliver liquid, such as water, to the tub 14 through a liquid supply outlet 56, which is shown by example as being positioned at one side of the tub 14. The washing machine 10 can further include a recirculation and drain system having a pump assembly 58 that can pump liquid from the tub 14 back into the tub 14 through a recirculation conduit 60 for recirculation of the liquid and/or to a drain conduit 62 to drain the liquid from the machine 10. The illustrated liquid supply system and recirculation and drain system for the washing machine 10 are provided for exemplary purposes only and are not limited to those shown in the drawings and described above.

The washing machine 10 can also be provided with a dispensing system for dispensing treating chemistry to the basket 24, either directly or mixed with water from the liquid supply system, for use in treating the laundry according to a cycle of operation. The dispensing system can include a dispenser 64 which can be a single use dispenser, a bulk dispenser, or a combination of a single use and bulk dispenser. Water can be supplied to the dispenser 64 from the liquid supply conduit 52 by directing the valve assembly 54 to direct the flow of water to the dispenser 64 through a dispensing supply conduit 66.

The washing machine 10 can also be provided with a heating system (not shown) to heat liquid provided to the treating chamber 32. In one example, the heating system can include a heating element provided in the sump 18 to heat liquid that collects in the sump 18. Alternatively, the heating system can be in the form of an in-line heater that heats the liquid as it flows through the liquid supply, dispensing, and/or recirculation systems.

The liquid supply, dispensing, and recirculation and drain systems can differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry. For example, the liquid supply system and/or the dispensing system can be configured to supply liquid into the interior of the tub 14 not occupied by the basket 24 such that liquid can be supplied directly to the tub 14 without having to travel through the basket 24.

The washing machine 10 can further include a control system for controlling the operation of the washing machine 10 to implement one or more treating cycles of operation. The control system can include a controller 70 located within a console 72 or elsewhere, such as within the cabinet 12, and a user interface 74 that is operably coupled with the controller 70. The user interface 74 can include one or more knobs, dials, switches, displays, touch screens, and the like for communicating with the user, such as to receive input and provide output. The user can enter different types of information including, without limitation, cycle selection and cycle parameters, such as cycle options.

The controller 70 can include the machine controller and any additional controllers provided for controlling any of the components of the washing machine 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
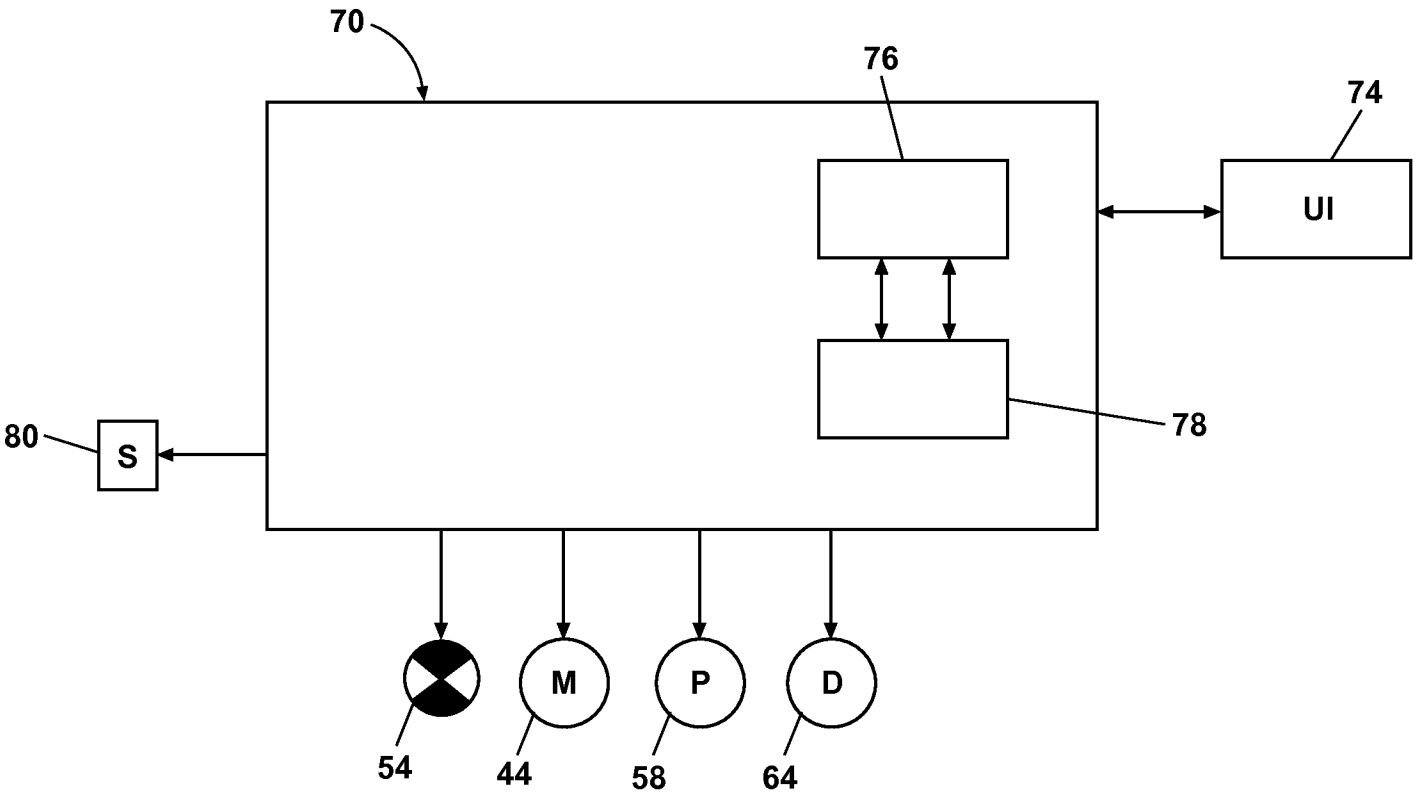
FIG. 2 is a schematic view of a control system for the laundry treating appliance of FIG. 1.

As illustrated in FIG. 2, the controller 70 can be provided with a memory 76 and a central processing unit (CPU) 78. The memory 76 can be used for storing the control software that is executed by the CPU 78 in completing a treating cycle of operation using the washing machine 10 and any additional software. Examples, without limitation, of treating cycles of operation include: wash, heavy duty wash, delicate wash, quick wash, pre-wash, refresh, rinse only, and timed wash. The memory 76 can also be used to store information, such as a database or table, and to store data received from one or more components of the washing machine 10 that can be communicably coupled with the controller 70. The database or table can be used to store the various operating parameters for the one or more cycles of operation, including factory default values for the operating parameters and any adjustments to them by the control system or by user input. Such information or operating parameters stored in the memory 76 can also include acceleration ramps, threshold values, predetermined criteria, etc.

The controller 70 can be operably coupled with one or more components of the washing machine 10 for communicating with and controlling the operation of the component to complete a cycle of operation. For example, the controller 70 can be operably coupled with the motor 44, the valve assembly 54, the pump 58, the dispenser 64, and any other additional components that can be present such as a steam generator and/or a sump heater (not shown) to control the operation of these and other components to implement one or more of the cycles of operation. The controller 70 can also be coupled with one or more sensors 80 provided in one or more of the systems of the washing machine 10 to receive input from the sensors, which are known in the art and not shown for simplicity. Such sensors 80 can include a motor torque sensor, a speed sensor, an acceleration sensor, and/or a position sensor providing an output or signal indicative of the torque applied by the motor 44, a speed of the basket 24 or component of the drive system, an acceleration of the basket 24 or component of the drive system, and a position sensor of the basket 24.

Figure 3:
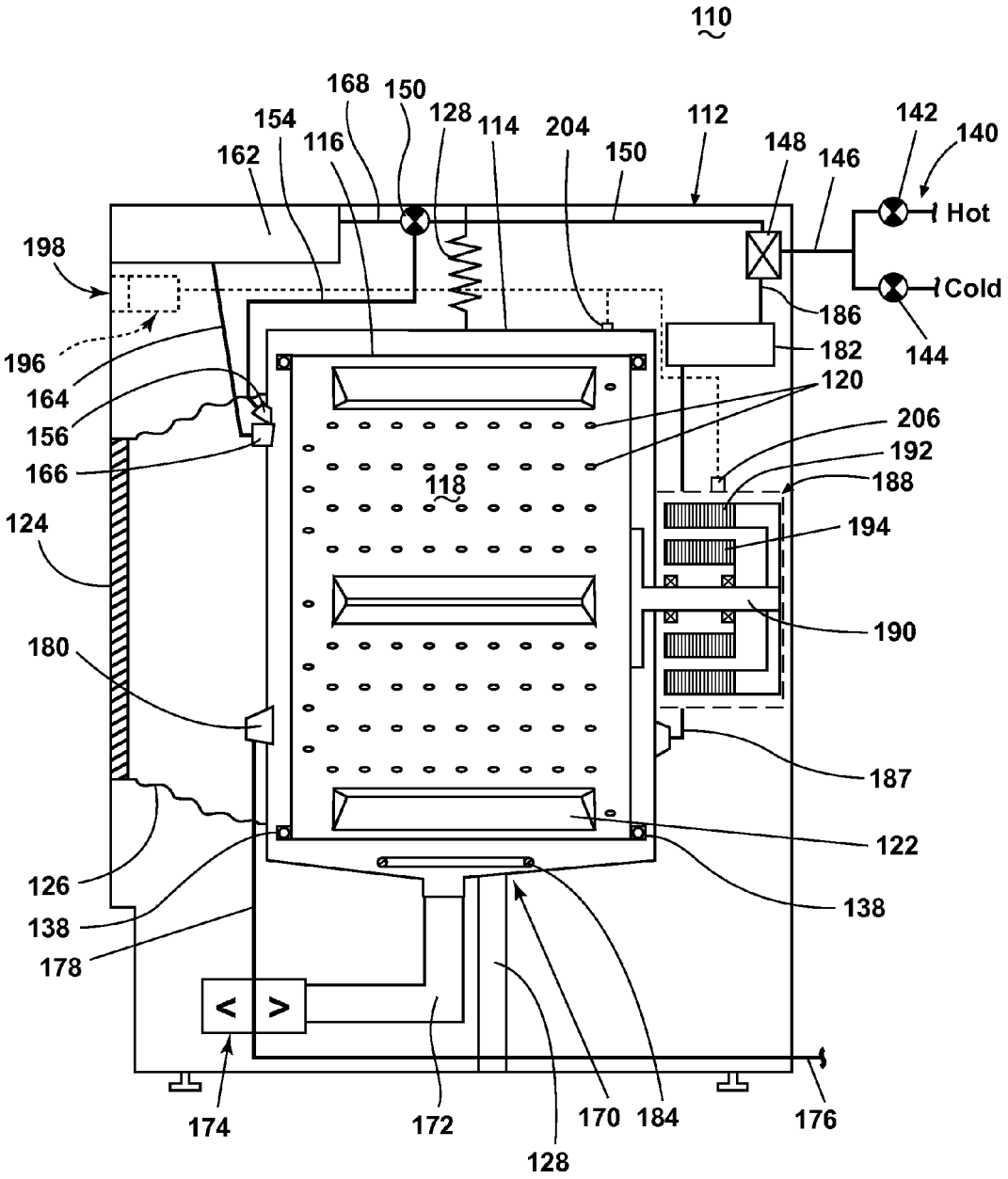
FIG. 3 is a schematic view of an alternative laundry treating appliance in the form of a horizontal washing machine.

Embodiments of the invention can also be utilized with alternative laundry treating appliances having a rotatable laundry-container including, but not limited to, a laundry treating appliance in the form of a horizontal-axis washing machine 110 as illustrated in FIG. 3. More specifically, the horizontal-axis washing machine 110 can be operated according to an embodiment of the invention to reduce the likelihood of contact between a rotating laundry-container and a tub. A structural support system including a cabinet 112 can define a housing within which a laundry holding system resides. The cabinet 112 can be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system includes a tub 114 supported within the cabinet 112 by a suitable suspension system and a rotatable laundry-container in the form of a drum 116 provided within the tub 114, the drum 116 defines at least a portion of a laundry treating chamber 118 for receiving a laundry load for treatment. The drum 116 can include a plurality of perforations 120 such that liquid can flow between the tub 114 and the drum 116 through the perforations 120. A plurality of baffles 122 can be disposed on an inner surface of the drum 116 to lift the laundry load received in the treating chamber 118 while the drum 116 rotates. It can also be within the scope of the invention for the laundry holding system to include only a tub with the tub defining the laundry treating chamber.

The laundry holding system can further include a door 124 which can be movably mounted to the cabinet 112 to selectively close both the tub 114 and the drum 116. A bellows 126 can couple an open face of the tub 114 with the cabinet 112, with the door 124 sealing against the bellows 126 when the door 124 closes the tub 114. The washing machine 110 can further include a suspension system 128 for dynamically suspending the laundry holding system within the structural support system.

The washing machine 110 can also include at least one balance ring 138 containing a balancing material moveable within the balance ring 138 to counterbalance an imbalance that can be caused by laundry in the treating chamber 118 during rotation of the drum 116. More specifically, the balance ring 138 can be coupled with the rotating drum 116 and configured to compensate for a dynamic imbalance during rotation of the rotatable drum 116. The balance ring 138 can extend circumferentially around a periphery of the drum 116 and can be located at any desired location along an axis of rotation of the drum 116. When multiple balance rings 138 are present, they can be equally spaced along the axis of rotation of the drum 116. For example, in the illustrated example a plurality of balance rings 138 are included in the washing machine 110 and the plurality of balance rings 138 are operably coupled with opposite ends of the rotatable drum 116.

The washing machine 110 can further include a liquid supply system for supplying water to the washing machine 110 for use in treating laundry during a cycle of operation. The liquid supply system can include a source of water, such as a household water supply 140, which can include separate valves 142 and 144 for controlling the flow of hot and cold water, respectively. Water can be supplied through an inlet conduit 146 directly to the tub 114 by controlling first and second diverter mechanisms 148 and 150, respectively. The diverter mechanisms 148, 150 can be a diverter valve having two outlets such that the diverter mechanisms 148, 150 can selectively direct a flow of liquid to one or both of two flow paths. Water from the household water supply 140 can flow through the inlet conduit 146 to the first diverter mechanism 148 which can direct the flow of liquid to a supply conduit 152. The second diverter mechanism 150 on the supply conduit 152 can direct the flow of liquid to a tub outlet conduit 154 which can be provided with a spray nozzle 156 configured to spray the flow of liquid into the tub 114. In this manner, water from the household water supply 140 can be supplied directly to the tub 114.

The washing machine 110 can also be provided with a dispensing system for dispensing treating chemistry to the treating chamber 118 for use in treating the laundry according to a cycle of operation. The dispensing system can include a dispenser 162 which can be a single use dispenser, a bulk dispenser or a combination of a single use and bulk dispenser.

Regardless of the type of dispenser used, the dispenser 162 can be configured to dispense a treating chemistry directly to the tub 114 or mixed with water from the liquid supply system through a dispensing outlet conduit 164. The dispensing outlet conduit 164 can include a dispensing nozzle 166 configured to dispense the treating chemistry into the tub 114 in a desired pattern and under a desired amount of pressure. For example, the dispensing nozzle 166 can be configured to dispense a flow or stream of treating chemistry into the tub 114 by gravity, i.e. a non-pressurized stream. Water can be supplied to the dispenser 162 from the supply conduit 152 by directing the diverter mechanism 150 to direct the flow of water to a dispensing supply conduit 168.

Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 110 can also include a recirculation and drain system for recirculating liquid within the laundry holding system and draining liquid from the washing machine 110. Liquid supplied to the tub 114 through tub outlet conduit 154 and/or the dispensing supply conduit 168 typically enters a space between the tub 114 and the drum 116 and can flow by gravity to a sump 170 formed in part by a lower portion of the tub 114. The sump 170 can also be formed by a sump conduit 172 that can fluidly couple the lower portion of the tub 114 to a pump 174. The pump 174 can direct liquid to a drain conduit 176, which can drain the liquid from the washing machine 110, or to a recirculation conduit 178, which can terminate at a recirculation inlet 180. The recirculation inlet 180 can direct the liquid from the recirculation conduit 178 into the drum 116. The recirculation inlet 180 can introduce the liquid into the drum 116 in any suitable manner, such as by spraying, dripping, or providing a steady flow of liquid. In this manner, liquid provided to the tub 114, with or without treating chemistry can be recirculated into the treating chamber 118 for treating the laundry within.

The liquid supply and/or recirculation and drain system can be provided with a heating system which can include one or more devices for heating laundry and/or liquid supplied to the tub 114, such as a steam generator 182 and/or a sump heater 184. Liquid from the household water supply 140 can be provided to the steam generator 182 through the inlet conduit 146 by controlling the first diverter mechanism 148 to direct the flow of liquid to a steam supply conduit 186. Steam generated by the steam generator 182 can be supplied to the tub 114 through a steam outlet conduit 187. The steam generator 182 can be any suitable type of steam generator such as a flow through steam generator or a tank-type steam generator. Alternatively, the sump heater 184 can be used to generate steam in place of or in addition to the steam generator 182. In addition or alternatively to generating steam, the steam generator 182 and/or sump heater 184 can be used to heat the laundry and/or liquid within the tub 114 as part of a cycle of operation.

Additionally, the liquid supply and recirculation and drain system can differ from the configuration shown in FIG. 3, such as by inclusion of other valves, conduits, treating chemistry dispensers, sensors, such as water level sensors and temperature sensors, and the like, to control the flow of liquid through the washing machine 110 and for the introduction of more than one type of treating chemistry.

The washing machine 110 also includes a drive system for rotating the drum 116 within the tub 114. The drive system can include a motor 188 for rotationally driving the drum 116. The motor 188 can be directly coupled with the drum 116 through a drive shaft 190 to rotate the drum 116 about a rotational axis during a cycle of operation. The motor 188 can be a brushless permanent magnet (BPM) motor having a stator 192 and a rotor 194. Alternately, the motor 188 can be coupled with the drum 116 through a belt and a drive shaft to rotate the drum 116, as is known in the art. Other motors, such as an induction motor or a permanent split capacitor (PSC) motor, can also be used. The motor 188 can rotationally drive the drum 116 including that the motor 188 can rotate the drum 116 at various speeds in either rotational direction. The motor 188 can be configured to rotatably drive the drum 116 in response to a motor control signal.

The washing machine 110 also includes a control system for controlling the operation of the washing machine 110 to implement one or more cycles of operation. The control system can include a controller 196 located within the cabinet 112 and a user interface 198 that is operably coupled with the controller 196. The user interface 198 can include one or more knobs, dials, switches, displays, touch screens, and the like for communicating with the user, such as to receive input and provide output. The user can enter different types of information including, without limitation, cycle selection and cycle parameters, such as cycle options.

The controller 196 can include the machine controller and any additional controllers provided for controlling any of the components of the washing machine 110. For example, the controller 196 can include the machine controller and a motor controller. Many known types of controllers can be used for the controller 196. It is contemplated that the controller can be a microprocessor-based controller that implements control software and sends/receives one or more electrical signals to/from each of the various working components to effect the control software.

Figure 4:
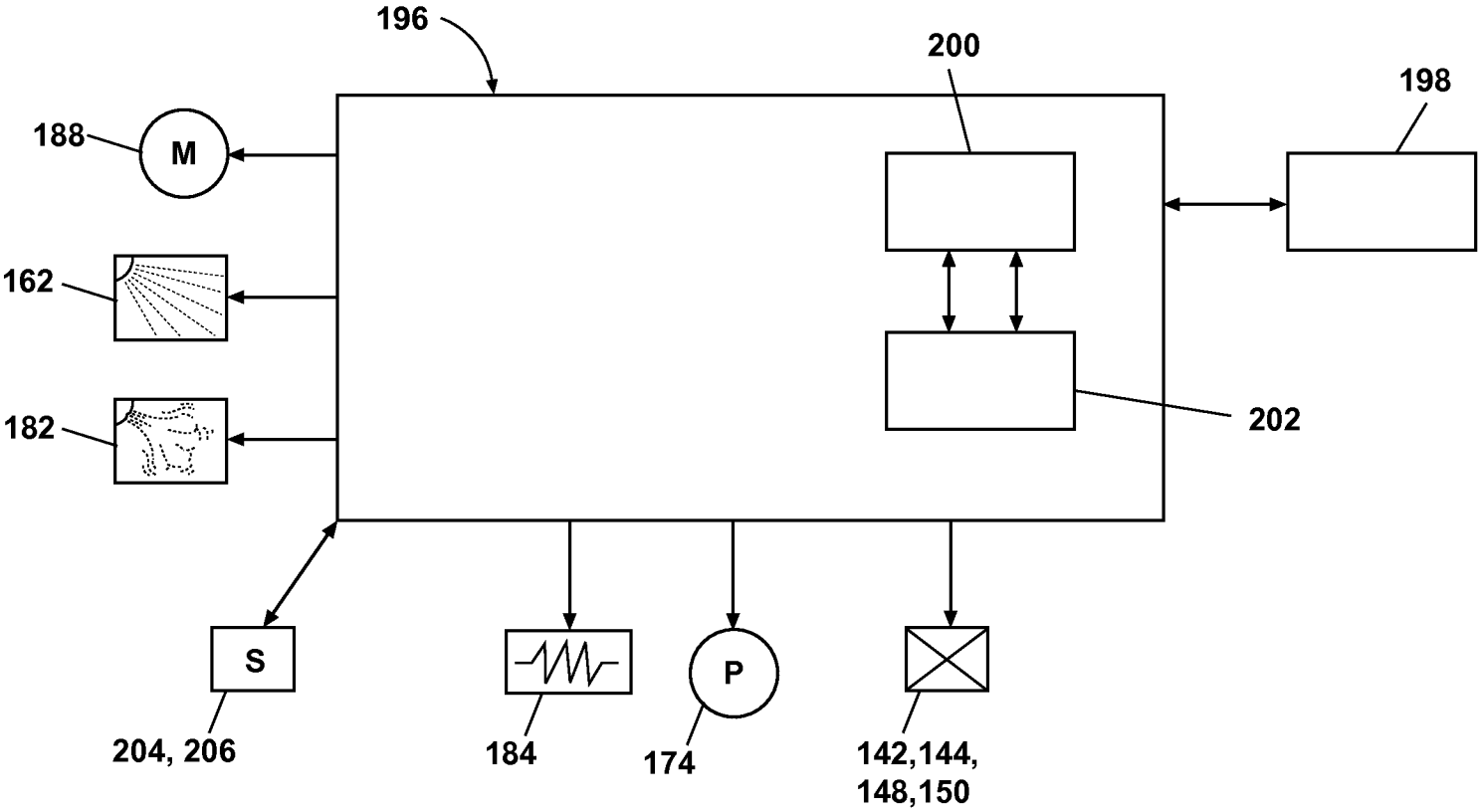
FIG. 4 is a schematic of a control system for the laundry treating appliance of FIG. 3.

As illustrated in FIG. 4, the controller 196 can be provided with a memory 200 and a central processing unit (CPU) 202. The memory 200 can be used for storing the control software that can be executed by the CPU 202 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 200 can also be used to store information, such as a database or table, and to store data received from one or more components of the washing machine 110 that can be communicably coupled with the controller 196. The database or table can be used to store the various operating parameters for the one or more cycles of operation, including factory default values for the operating parameters and any adjustments to them by the control system or by user input. Such operating parameters and information stored in the memory 200 can include, but are not limited to, acceleration ramps, threshold values, predetermined criteria, etc.

The controller 196 can be operably coupled with one or more components of the washing machine 110 for communicating with and controlling the operation of the component to complete a cycle of operation. For example, the controller 196 can be operably coupled with the motor 188, the pump 174, the dispenser 162, the steam generator 182 and the sump heater 184 to control the operation of these and other components to implement one or more of the cycles of operation.

The controller 196 can also be coupled with one or more sensors 204 provided in one or more of the systems of the washing machine 110 to receive input from the sensors, which are known in the art and not shown for simplicity. Non-limiting examples of sensors 204 that can be communicably coupled with the controller 196 include: a treating chamber temperature sensor, a moisture sensor, a weight sensor, a chemical sensor, a position sensor, an acceleration sensor, a speed sensor, an orientation sensor, an imbalance sensor, a load size sensor, and a motor torque sensor, which can be used to determine a variety of system and laundry characteristics, such as laundry load inertia or mass and system imbalance magnitude and position.

For example, sensors 206 such as a motor torque sensor, a speed sensor, an acceleration sensor, and/or a position sensor can also be included in the washing machine 110 and can provide an output or signal indicative of the torque applied by the motor, a speed of the drum 116 or component of the drive system, an acceleration of the drum or component of the drive system, and a position sensor of the drum 116. Such sensors 206 can be any suitable types of sensors including, but not limited to, that one or more of the sensors 206 can be a physical sensor or can be integrated with the motor and combined with the capability of the controller 196 to function as a sensor. For example, motor characteristics, such as speed, current, voltage, torque etc., can be processed such that the data provides information in the same manner as a separate physical sensor. In contemporary motors, the motors often have their own controller that outputs data for such information.

During operation of the washing machine 10 or the washing machine 110, an off-balance bending moment at high speeds can flex the basket 24 or drum 116 allowing the container to contact, e.g., rub, against the tub 14 or 114, respectively. Such excessive bending moments and axial forces can cause failure in the drive unit components. This can result in a loud noise, tub damage over time, expulsion of treating liquid from the tub, etc. It has been determined that by monitoring the variation of friction it can be possible to predict contact with the tub of a laundry treating appliance and operate the laundry treating appliance to reduce the likelihood of container-tub contact. The term friction can include a value indicative of the viscous friction, a value indicative of the Coulomb friction, a value indicative of a combination of the viscous and Coulomb friction, or a value indicative of the rate of change of one of the frictions.

During operation of the washing machine 10 or the washing machine 110, the controller 70 or 196 can be configured to output a motor control signal to the motor 44 or 188 to rotate the basket 24 or drum 116. When the basket 24 or drum 116 with the laundry load rotates during an extraction phase, the distributed mass of the laundry load about the interior of the basket 24 or drum 116 is a part of the inertia of the rotating system of the basket 24 or drum 116 and laundry load, along with other rotating components of the laundry treating appliance. The rotational damping coefficient or friction within the system can be determined from a variety of factors including the torque necessary to rotate the basket 24 or drum 116. Generally the motor torque for rotating the basket 24 or drum 116 with an off-balance laundry load can be represented in the following equation:

$$\tau=J*\dot{\omega}+B*\omega+C+\alpha\ \sin(\omega t+\varphi) \quad (1)$$

where, $\tau$=torque, J=inertia, $\dot{\omega}$=acceleration, $\omega$=rotational speed, B=viscous friction, C=coulomb friction, $\alpha$=a first harmonic vibration, and $\omega t+\varphi$=angular position of the laundry-container relative to a fixed axis.

For horizontal axis washers, the fixed axis will be an axis parallel to the gravity vector, thus, $wt+\varphi=0$ means that the angular position of the drum is such that the off-balance mass is at the bottom of the tub relative to an outside observer. Similarly, $wt+\varphi=180$ means that the off-balance mass is at the top of the drum viewed from outside. For vertical axis washers, the fixed axis is the gravity vector projected on a 2-D cross-sectional plane of the basked viewed from the top. The projected gravity vector will have the magnitude g*sin(tilt), where tilt represents the tilt angle of the ground surface, and the direction of the fixed axis will depend on the direction of inclination of the surface where the washer is placed.

The friction value can be determined without dwelling at a constant speed by utilizing a parameter estimator to determine, such as by estimation or calculation, the friction, which can for practical purposes be done in real time. The mathematical model of the washing machine 10 or 110 embedded into equation (1) is used to decompose the friction into measured physical quantities from torque, speed, and position. Acceleration can also be utilized as an input. Further still, estimated electrical signals or motor signals can also be utilized as inputs including, but not limited to, currents, voltages, etc. The characteristics of the inertia, viscous friction, coulomb frictions, and the first harmonic vibration can all be estimated parameters. Any suitable methodology or algorithm, proprietary or known, such as a recursive least squares algorithm, can be used to estimate the parameters in such a model.

Thus, during operation the controller 70 or 196 can monitor over time a torque signal, a speed signal, an acceleration signal, and a position signal during the rotation of the basket 24 or drum 116. The controller 70 or 196 can also repeatedly determine or estimate the friction based thereon, which may be done continuously. Such friction can be monitored and from the monitored friction the controller 70 or 196 can predict a container-tub contact. More specifically, the friction value can be correlated to a gap size between the rotating laundry-container and the tub and predict contact between the laundry-container and the tub. The centrifugal forces acting on the laundry-container bend the basket-shaft system towards the tub and lead to a decreased gap. It has been determined that the friction relates to the shaft bending within the washing machine 10, 110 as increased shaft bending and increased axial baring loads create increased rotational friction in the bearings. As the gap between the container and the tub approaches zero or a basket-tub contact it has been determined that the slope of the friction or the friction value increases.

Figure 5:
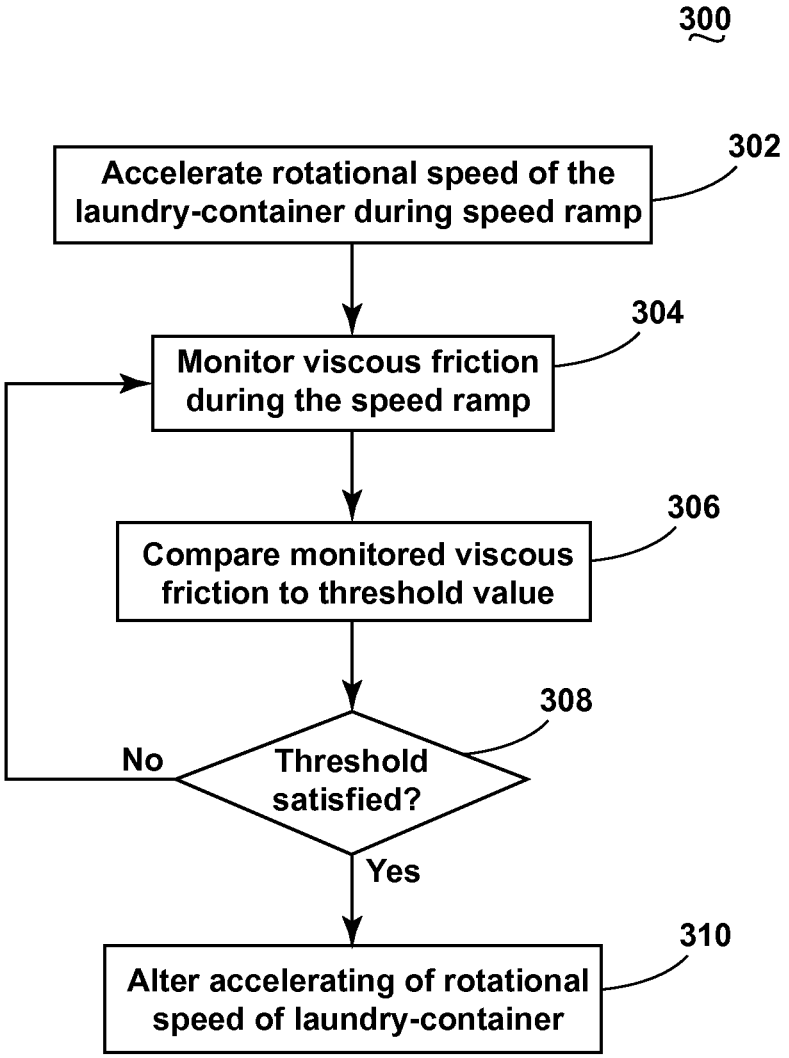
FIG. 5 is a flow chart illustrating a method of operating a laundry treating appliance including the washing machines of FIGS. 1 and 3.

The previously described washing machines 10 and 110 can be used to implement one or more embodiments of a method of the invention. Referring now to FIG. 5, a flow chart of a method 300 for reducing the likelihood of contact between a rotating laundry-container and a tub of a laundry treating appliance is illustrated. The sequence depicted for the method 300 is for illustrative purposes only, and is not meant to limit the method in any way as it is understood that the method 300 can proceed in a different logical order or additional or intervening steps can be included without detracting from the invention. The method 300 can be implemented in any suitable manner, such as automatically or manually, as a stand-alone phase or cycle of operation or as a phase of an operation cycle of the washing machine 10. Further, the description of the method 300 is limited to the use of the term viscous friction for ease of description. However, it will be understood that any suitable friction may be utilized including a total friction that is equal to $B*\omega+C$, etc.

At 302, the controller 70 or 196 can rotate the drum basket 24 or drum 116 and accelerate the rotational speed of the basket 24 or drum 116 during an extraction cycle speed ramp. More specifically, the controller 70 or 196 can cause the acceleration through operation of the motor 44 or 188.

This can be done as part of an execution of the automatic cycle of operation. The basket 24 or drum 116 can be accelerated using any suitable speed ramp. This can include, but is not limited to, that the accelerating can include accelerating the speed of the rotating laundry-container with a time-varying acceleration rate or at a fixed acceleration rate. For example, for a fixed acceleration rate, a fixed acceleration input to the motor 44 or 188, which is used to rotate the basket 24 or drum 116. By way of non-limiting example, the speed ramp can include that the basket 24 or drum 116 is rotated from a non-satellizing speed to a satellizing speed. It is contemplated that the satellizing speed can be a predetermined speed or can be a speed at which the controller 70 or 196 determines the laundry can be satellized.

While the basket 24 or drum 116 is being accelerated during the speed ramp, the viscous friction associated with the rotating laundry-container can be monitored as indicated at 304. Monitoring the viscous friction can include, but is not limited to estimating the viscous friction and monitoring the estimated viscous friction. The viscous friction can be estimated using a parameter estimator as described above wherein torque, acceleration, speed, and position measurements are utilized to estimate the viscous friction.

The monitored viscous friction can then be compared to a threshold value at 306. The threshold value can be a threshold viscous friction value, which is correlated to a gap size between the rotating laundry-container and the tub. At 308 it can be determined if the monitored viscous friction satisfies the threshold value. The term "satisfies" the threshold is used herein to mean that the monitored friction satisfies the predetermined threshold, such as being equal to, less than, or greater than the threshold value. It will be understood that such a determination can easily be altered to be satisfied by a positive/negative comparison or a true/false comparison. For example, a less than threshold value can easily be satisfied by applying a greater than test when the data is numerically inverted. In implementation, the threshold viscous friction value and comparisons can be converted to an algorithm to predict container-tub contact for the laundry treating appliance. Such an algorithm can be converted to a computer program including a set of executable instructions, which can be executed by the controller 70 or 196.

By way of example only, it is contemplated that the threshold can be determined to be satisfied when the comparison at 306 indicates the monitored viscous friction exceeds the threshold viscous friction value. If the monitored viscous friction does not satisfy the threshold value, then the method can continue to monitor the viscous friction at 304. If the monitored viscous friction satisfies the threshold value, the accelerating of the rotational speed of laundry-container 310 can be altered at 310. Altering the accelerating can include, but is not limited to, reducing the rate of acceleration. The rate of acceleration can be reduced in any suitable manner including by way of non-limiting example stopping the acceleration. Stopping the increase in speed or otherwise altering the accelerating will reduce the likelihood of a container-tub contact within the laundry treating appliance.

It will be understood that the method can be flexible and that the method 300 illustrated is merely for illustrative purposes. For example, it is contemplated that if the acceleration is stopped at 310 then the controller 70 or controller 196 can continue the stopping of the acceleration until a predetermined criteria is met to define a dwell plateau at a constant speed. By way of non-limiting examples, the predetermined criteria can include the viscous friction satisfying a resume ramp threshold and the constant speed can correspond to the speed at which the threshold was satisfied at 308. When the resume ramp threshold is satisfied the rotational speed of the laundry container can again be accelerated.

Monitoring the friction can include, but is not limited to estimating the friction and monitoring the estimated friction. Monitoring the friction can include repeatedly determining the friction. If monitoring the friction includes estimating the friction then this can include repeatedly estimating the friction. Repeatedly determining the friction can include continuously, repeatedly estimating the friction.

Figure 6:
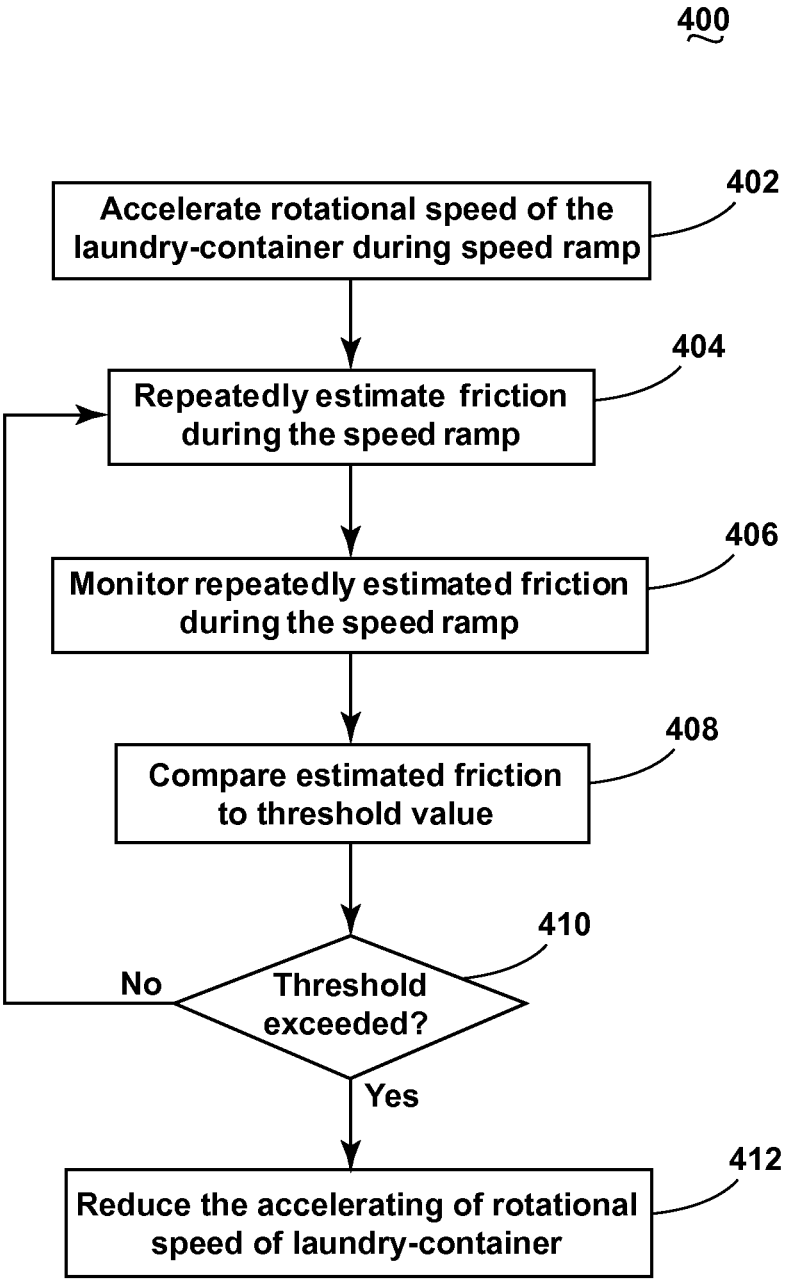
FIG. 6 is a flow chart illustrating a method of operating a laundry treating appliance including the washing machines of FIGS. 1 and 3.

To monitor the rate of change or slope of the friction the friction value must be repeatedly determined. FIG. 6 illustrates an exemplary flow chart of a method 400 wherein the friction is repeatedly determined. Again, the sequence depicted for the method 400 is for illustrative purposes only, and is not meant to limit the method in any way. The method 400 is similar to the method 300 in that it beings at 402 by accelerating the rotational speed of the basket 24 or drum 116 during an extraction cycle speed ramp. As with the previously described method, the controller 70 or 196 can cause the acceleration through operation of the motor 44 or 188 and the basket 24 or drum 116 can be accelerated using any suitable speed ramp.

While the basket 24 or drum 116 is being accelerated during the speed ramp, the friction associated with the rotating laundry-container can be repeatedly calculated, determined, or estimated at 404. By way of non-limiting example, the friction can be repeatedly estimated utilizing a parameter estimator during the speed ramp based on torque, speed, acceleration, and position information. It is contemplated that the method 400 can continuously estimate the friction including a raw friction value or a slope of the friction with respect to rotational speed of the laundry-container as the laundry-container ramps up to reach a maximum spin speed.

At 406, the estimated friction can be repeatedly monitored during the speed ramp and at 408 the estimated friction can be compared to a threshold value. In the case where the slope or rate of change of the friction is monitored, such a slope can be compared to a threshold friction value, which is correlated to a gap size between the rotating laundry-container and the tub 14 or 114.

At 410 it can be determined whether the comparison indicates that the slope of the friction exceeds the threshold friction. In implementation, the threshold and comparisons can be converted to an algorithm to predict container-tub contact for the laundry treating appliance. Such an algorithm can be converted to a computer program including a set of executable instructions, which can be executed by the controller 70 or 196.

If the monitored friction slope does not exceed the threshold value, then the method can continue to estimate the friction at 404. If the monitored friction slope exceeds the threshold value, the accelerating of the rotational speed of the laundry-container can be reduced at 412. The rate of acceleration can be reduced in any suitable manner including by way of non-limiting example stopping the acceleration. By way of non-limiting example, the rotational speed can be maintained at a constant speed to define a dwell plateau include at the rotational speed where the threshold was exceeded. Stopping the increase in speed or otherwise reducing the rate of acceleration will reduce the likelihood of a container-tub contact within the laundry treating appliance.

It will be understood that the method can be flexible and that the method 400 illustrated is merely for illustrative purposes. For example, if the rotational speed is maintained to create a dwell plateau it is contemplated that the friction can continue to be estimated and monitored during the dwell plateau. The friction can then be compared to a threshold that indicates that a container-tub contact is not predicted. Such a threshold can be considered a resume ramp threshold because the speed ramp can be resumed. When the threshold is satisfied, the rotational speed of the laundry container can be accelerated from the dwell plateau. In this manner, the speed ramp can be resumed up to a maximum speed if the friction estimate reduces to be below the pre-defined resume ramp threshold.

Further still, during the dwell plateau the friction estimate can be compared with a second threshold that indicates that the friction estimate is increasing during the dwell plateau. If the friction estimate continues to increase such that it exceeds such a pre-defined deceleration threshold, the washing machine 10 or 110 can be operated to slow down the rotational speed of the basket 24 or drum 116. During such a deceleration the friction can continue to be estimated, monitored, and compared and it can be determined if the friction reduces below a pre-defined resume dwell threshold where the speed ramp can again be resumed.

Further, while the above description uses the term friction it will be understood that the monitored friction can include a value indicative of the viscous friction, a value indicative of the Coulomb friction, a value indicative of a combination of the viscous and Coulomb friction, or a value indicative of the rate of change of one of the frictions. Any of these can be monitored and utilized in the comparison, the determination that the threshold friction value has been exceeded, etc.

Figure 7:
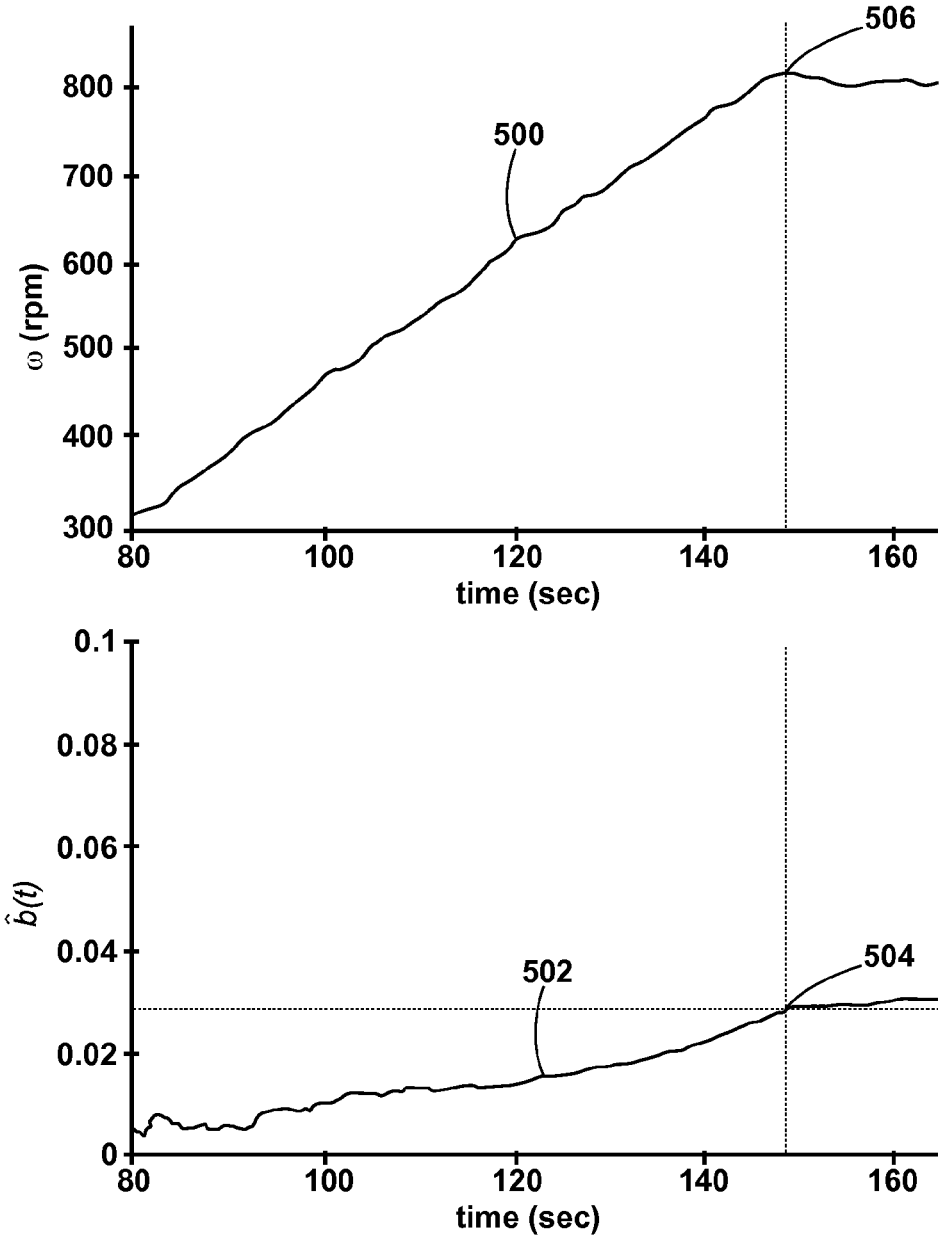
FIG. 7 is an illustration showing a first plot illustrating a speed ramp and forced dwell and a second plot showing a monitored friction value.

FIG. 7 illustrates a speed ramp 500 that shows the speed of the container being increased over time. While a relative constant acceleration is being utilized it will be understood that this need not be the case. A corresponding plot showing the monitored friction slope is indicated in the second plot as 502. At 504, the friction value threshold is exceeded while the speed is being ramped up. By way of non-limiting example, the accelerating is then altered by forcing a dwell plateau at 506. In the plot the speed ramp 500 is stopped at 817 rpms and the dwell is set at 807 rpms. It is contemplated that any suitable friction threshold value can be utilized including one of several contact detection margins. Such suitable margins can be defined through routine experimentation as a speed at which contact occurred minus the speed at which threshold was passed. For example, the viscous friction coefficient B can be monitored as the slope of the total rotational friction "B*w+c" (N-m) with respect to the angular speed w (rad/s). In such an instance, a "late detection" threshold could be equal to a value of 0.042 N-m-s/rad, a "mid detection" threshold could be equal to value of 0.028 N-m-s/rad, and an "early detection" threshold could be equal to a value of 0.02 N-m-s/rad.

Further, it has also been determined that a bending moment of the motor drive shaft can also be determined based on the monitored friction similar to the principles described above. By way of non-limiting example, for certain off-balance conditions including, but not limited to, those that are mid-level and high in the rotating laundry-container, monitored friction can be used to constrain the bending moment. If left unconstrained, the bending moments can result in drive plate fatigue, drive attachment damage, suspension wear, etc. More specifically, the friction associated with the rotating laundry-container can be monitored and compared to a threshold friction value, which is correlated to a bending moment. The laundry treating appliance can be operated to reduce the bending moment, such as by altering the accelerating of the rotational speed of the rotating laundry-container, when the comparing indicates the threshold is satisfied.

Further still, axial forces on the motor drive shaft can be determined utilizing similar principles of monitoring the friction. That is, the friction associated with the rotating laundry-container can be monitored and compared to a threshold friction value, which is correlated to axial forces on the motor drive shaft and when it is determined that the axial forces exceed the threshold friction value, the laundry treating appliance can be operated to reduce such axial forces.

The above-described embodiments provide a variety of benefits including that a likelihood of contact between a rotating laundry-container, such as a basket or drum, and a tub is reduced or eliminated because the high-speed ramp can be altered based on monitored friction. This results in preventing the basket or drum from contacting, hitting, or shredding the tub and causing physical degradation in the machine. The above-described embodiments also enable the washing machine to spin up to higher speeds with no increased risk of damaging the washing machine, which can lead to an improvement in cycle time as well as an improvement in product life and reliability. Furthermore, the above-described embodiments can enable larger capacity by decreasing the gap between the rotating laundry-container and the tub with limited risk of container-tub contact.

The above-described embodiments are more accurate and precise as compared to the existing solution, as the determination is driven directly by the likelihood of contact, rather than load factors such as off-balance mass or off-balance height, which, as mentioned before, can sometimes fail to prevent contact. Furthermore, the above-described embodiments offer a solution that continuously provides information about the likelihood of contact, rather than relying on an extrapolation carried out at lower speeds, which might not capture the true high-speed behavior of the washing machine. Furthermore, the above-described embodiments do not require dwells, or any specific spin cycle to be performed.

To the extent not already described, the different features and structures of the various embodiments can be used in combination with each other as desired. That one feature is not illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of reducing a likelihood of contact between a rotating laundry-container located within a tub of a laundry treating appliance, the method comprising:

accelerating a rotational speed of the rotating laundry-container during an extraction cycle speed ramp;

measuring torque, speed, acceleration, and position during the speed ramp;

repeatedly estimating, by a controller utilizing a parameter estimator, a friction associated with the rotating laundry-container during the speed ramp based on the torque, speed, acceleration, and position measurements;

monitoring the repeatedly estimated friction during the speed ramp;

comparing the estimated friction to a threshold friction value, which is correlated to a gap size between the rotating laundry-container and the tub;

determining when the comparing indicates that the friction exceeds the threshold friction; and reducing the accelerating of the rotational speed of the rotating laundry-container when the comparing indicates the threshold friction is exceeded.

2. The method of claim 1 wherein the reducing the accelerating of the rotational speed comprises maintaining the rotational speed at a constant speed to define a dwell plateau.

3. The method of claim 2, further comprising accelerating the rotational speed of the laundry container from the dwell plateau upon the satisfying of a resume ramp threshold.

4. The method of claim 1 wherein the estimated friction is a raw friction value or a slope of a change in the repeatedly estimated friction over time.

5. A method of reducing a likelihood of contact between a rotating laundry-container located within a tub of a laundry treating appliance, the method comprising:

accelerating a rotational speed of the rotating laundry-container during an extraction cycle speed ramp;

monitoring, by a controller, the friction associated with the rotating laundry-container during the speed ramp;

comparing the monitored friction to a threshold friction value, which is correlated to a gap size between the rotating laundry-container and the tub; and altering the accelerating of the rotational speed of the rotating laundry-container when the comparing indicates the threshold is satisfied.

6. The method of claim 5 wherein the accelerating comprises accelerating the rotational speed of the rotating laundry-container at a fixed acceleration rate.

7. The method of claim 6 wherein the fixed acceleration rate comprises providing a fixed acceleration input to a motor rotating the rotating laundry-container.

8. The method of claim 5 wherein monitoring the friction comprises the controller estimating the friction and monitoring the estimated friction.

9. The method of claim 8 wherein estimating the friction comprises estimating the friction using a parameter estimator.

10. The method of claim 9 wherein torque, speed, and position measurements are utilized in the parameter estimator.

11. The method of claim 8 wherein estimating the friction comprises repeatedly estimating the friction.

12. The method of claim 5 wherein the monitoring the friction comprises the controller repeatedly determining the friction.

13. The method of claim 5 wherein the monitored friction is a raw viscous friction value or a rate of change of viscous friction.

14. The method of claim 5, further comprising determining the threshold is satisfied when the comparing indicates the monitored friction exceeds the threshold friction value.

15. The method of claim 5 wherein the altering the accelerating comprises reducing a rate of acceleration.

16. The method of claim 15 wherein reducing the rate of acceleration comprises stopping the acceleration.

17. The method of claim 16 wherein the stopping the acceleration is done until a predetermined criteria is met to define a dwell plateau at a constant speed, corresponding to the speed at which the threshold is satisfied and where the predetermined criteria comprises the friction satisfying a resume ramp threshold.

18. The method of claim 17, further comprising again accelerating the rotational speed of the laundry container upon the satisfying of the resume ramp threshold.

* * * * *